US007984590B2

(12) United States Patent
Hoshide et al.

(10) Patent No.: US 7,984,590 B2
(45) Date of Patent: Jul. 26, 2011

(54) AUTOMATIC DOOR APPARATUS

(75) Inventors: Kaoru Hoshide, Tokyo (JP); Miki Tobita, Tokyo (JP); Akira Sato, Tokyo (JP)

(73) Assignee: THK Co., Ltd., Tokyo (JP)

( * ) Notice: Subject to any disclaimer, the term of this patent is extended or adjusted under 35 U.S.C. 154(b) by 1266 days.

(21) Appl. No.: 10/572,374

(22) PCT Filed: Sep. 8, 2004

(86) PCT No.: PCT/JP2004/013060

§ 371 (c)(1),
(2), (4) Date: Mar. 16, 2006

(87) PCT Pub. No.: WO2005/028795

PCT Pub. Date: Mar. 31, 2005

(65) Prior Publication Data

US 2007/0094932 A1 May 3, 2007

(30) Foreign Application Priority Data

Sep. 17, 2003 (JP) ..... 2003-325265

(51) Int. Cl.
*E05F 15/20* (2006.01)

(52) U.S. Cl. ..... 49/31; 49/370

(58) Field of Classification Search ..... 49/31, 116, 49/117, 118, 120, 366, 367, 370; 340/541, 340/545.2, 5.7, 5.71; 318/282, 286, 466, 318/468, 467

See application file for complete search history.

(56) References Cited

U.S. PATENT DOCUMENTS

| | | | | | |
|---|---|---|---|---|---|
| 4,604,826 | A | * | 8/1986 | Sorber | 49/31 |
| 4,697,383 | A | * | 10/1987 | Hagiwara | 49/25 |
| 4,847,485 | A | * | 7/1989 | Koelsch | 250/221 |
| 5,247,763 | A | * | 9/1993 | Hein | 49/31 |
| 5,347,755 | A | * | 9/1994 | Jaster et al. | 49/25 |
| 5,453,736 | A | * | 9/1995 | Noren | 340/5.6 |
| 5,583,405 | A | * | 12/1996 | Sai et al. | 318/286 |

(Continued)

FOREIGN PATENT DOCUMENTS

JP 5-229756 A 9/1993

(Continued)

OTHER PUBLICATIONS

International Search Report of PCT/JP2004/013060 dated Dec. 21, 2004.

(Continued)

*Primary Examiner* — Jerry Redman
*Assistant Examiner* — Catherine A Kelly
(74) *Attorney, Agent, or Firm* — Westerman, Hattori, Daniels & Adrian, LLP

(57) ABSTRACT

At both sides of a pair of doors 10L, 10R, a pair of television cameras (two-dimensional image sensors) 18A, 18B for detecting a moving object, and a pair of spare infrared ray sensors 20A, 20B are provided. A central control unit 16 calculates the position and moving direction of moving object by image processing of outputs of television cameras 18A, 18B, and predicts the passing position of moving object on the vertical plane P when the moving object approaches, thereby calculating the target opening degree of a pair of doors 10L, 10R individually, and determines the target opening degree of doors in full closing when the moving object leaves away, and thus outputs move command signals to motor controllers 14L, 14R so that the pair of doors 10L, 10R may be set at the target opening degree.

5 Claims, 8 Drawing Sheets

U.S. PATENT DOCUMENTS

| | | | | |
|---|---|---|---|---|
| 5,594,316 | A * | 1/1997 | Hayashida | 49/31 |
| 6,084,367 | A * | 7/2000 | Landert | 318/466 |
| 6,496,220 | B2 * | 12/2002 | Landert et al. | 348/143 |
| 6,914,401 | B2 * | 7/2005 | Semelka | 318/480 |
| 7,042,492 | B2 * | 5/2006 | Spinelli | 348/143 |
| 7,400,744 | B2 * | 7/2008 | Nichani et al. | 382/103 |

FOREIGN PATENT DOCUMENTS

| | | | |
|---|---|---|---|
| JP | 6-307157 | A | 11/1994 |
| JP | 7-269227 | A | 10/1995 |
| JP | 10-8825 | A | 1/1998 |
| JP | 2000-54728 | A | 2/2000 |
| JP | 2000-194854 | A | 7/2000 |
| JP | 2002-267768 | A | 9/2002 |

OTHER PUBLICATIONS

International Search Report of PCT/JP2004/013060, date of mailing Dec. 21, 2004.

Japanese Office Action dated Nov. 11, 2008, issued in corresponding Japanese Patent Application No. 2003-325265.

* cited by examiner

AUTOMATIC DOOR APPARATUS

TECHNICAL FIELD

The present invention relates to an automatic door apparatus having a pair of doors moving on a same vertical plane, and controlling means for opening and closing the doors automatically.

BACKGROUND ART

A control device for opening and closing double doors automatically comprises a pair of infrared ray detectors disposed at both sides of doors (inside and outside) near the doors in general, and is designed to open the both doors (right and left) simultaneously to the full when a human body as a moving object is detected by the detectors, and close when the human body leaves the detecting range of the detectors (or by the timer) In such simple opening and closing control of doors, the doors are open more than necessary when only one person passes or are closed long after than necessary, and the air conditioning efficiency is sacrificed.

This problem is solved by the automatic door opening and closing control method disclosed in patent document 1. In this automatic door opening and closing control method, a plurality of detectors are installed at both sides of doors, and full opening or half opening is determined depending on the number of persons approaching the doors and their positions. In this automatic door opening and closing control method, however, since the doors are controlled only on the basis of the position information of persons, if a person stands still in detecting range, the doors are kept open. Besides, since both doors are opened and closed simultaneously, if a person approaches one door, both doors are opened.

This problem is solved by the automatic door opening and closing control system disclosed in patent document 2. In this automatic door opening and closing control system, if a moving object approaches the doors, the passing position of the moving object is predicted on the basis of the position and direction of the moving object, and the target opening degree of each door is individually calculated on the basis of the predicted passing position. The automatic door opening and closing control system opens one door only, opens both doors slightly, or opens both doors fully depending on the passing position of moving object(s). As a result, the both doors are opened in various modes, and the door opening degree is the minimum required limit.

Patent document 1: Japanese Unexamined Patent Publication No. 60-13184 (Japanese Examined Patent Publication No. 3-17996)

Patent document 2: Japanese Unexamined Patent Publication No. 6-307157

DISCLOSURE OF THE INVENTION

Problems that this Invention is to Solve

However, patent document 2 includes many vague descriptions of opening and closing control method of automatic doors, and does not disclose the technical fact that can be executed easily by those skilled in the art. In this automatic door control system, two-dimensional image sensors are installed at both sides of a pair of doors, and outputs of the two-dimensional image sensors are image-processed, and the position and direction of moving objects are calculated. In this automatic door control system, however, no countermeasure is suggested about how to correct when image processing is disable due to trouble or optical conditions, or about how to correct if an individual moving object cannot be distinguished in the crowd.

The present invention is devised in the light of the above problems, and it is hence an object thereof to provide an automatic door apparatus capable of opening a pair of doors in various modes and by a minimum required limit depending on the position, direction, and speed of moving objects, and solving problems if image processing is disable due to trouble of two-dimensional output, or if an individual moving object cannot be distinguished in the crowd.

Means for Solving the Problems

According to the present invention, there is provided an automatic door apparatus comprising: a pair of doors opening and closing by moving on a same vertical plane; a pair of moving means for moving the pair of doors individually; control means for controlling the pair of moving means; a pair of two-dimensional image sensors for detecting a moving object at both sides of the pair of doors; and a pair of spare sensors for detecting a moving object at both sides of the pair of doors. The control means includes: moving status calculating means for calculating a position and a moving direction of a moving object by image processing of outputs of the two-dimensional image sensors; opening degree calculating means for predicting a passing position of the moving object on the vertical plane on the basis of the position and moving direction of the moving object calculated by the moving status calculating means and calculating a target opening degree of each of the doors on the basis of the predicted passing position when the moving object approaches, and for determining the target opening degrees of the doors in fully closed state when the moving object moves away; first move command means for outputting move command signals to the pair of moving means so that the doors may be opened to the calculated target opening degrees; and second move command means for outputting move command signals to the pair of moving means to open or close the doors fully in accordance with outputs from the spare sensors in the event of image processing failure of the moving status calculating means.

In this constitution, the target opening degree of each of the pair of doors is individually calculated on the basis of the predicted passing position of moving object. As a result, the both doors are opened in various modes, and the door opening degree is the minimum required limit, so that the air conditioning effect is enhanced. If the position and moving direction of moving object cannot be calculated due to failure of image processing by the moving status calculating means, the both doors are controlled to be opened and closed to the full (this is the generic operation mode of automatic doors) by using the detection output from the spare sensors, so that smooth passing is assured.

Preferably, the control means immediately outputs a door full opening move command signal to the pair of moving means by the second move command means, if the moving status calculating means cannot calculate the position and moving direction of the moving object due to failure of the image processing of individually recognizing the moving object.

In this constitution, if image processing is disabled due to the crowd or other problem, the doors are immediately opened to the full, and smooth passing is assured.

Preferably, the control means selects a largest opening degree, as the target opening degree of the door, from plural target opening degrees corresponding to plural moving objects calculated by the opening degree calculating means. In this constitution, smoother passing is assured.

Preferably, the moving status calculating means has opening speed calculating means for calculating a moving speed of each moving object and calculating an opening speed of the doors on the basis of the fastest moving speed among the calculated moving speeds, and the first move command means outputs a move command signal so as to open the doors at the opening speed. In this constitution, smoother passing is assured.

Preferably, a zone detected by the two-dimensional image sensor includes a first zone remote from the doors, and a second zone adjacent to the first zone and closer to the doors than the first zone, the moving status calculating means calculates the moving status of the moving object on the basis of the motion of the moving object in the first zone, and the opening degree calculating means calculates the target opening degree when the moving object moves from the first zone to the second zone, and the first move command means outputs the move command signal. In this constitution, smooth passing depending on the moving status of moving object is assured, and the air conditioning effect is enhanced.

Preferably, a zone detected by the two-dimensional image sensor includes a first zone remote from the doors, and a second zone adjacent to the first zone and closer to the doors than the first zone, and the opening status calculating means sets the target opening degree in full closing when the moving object moves from the second zone to the first zone, and the first move command means outputs the move command signal. In this constitution, smooth passing depending on the moving status of moving object is assured, and the air conditioning effect is enhanced.

EFFECTS OF THE INVENTION

According to the invention, doors are opened in various modes, and the doors are opened by a minimum required limit depending on the position, direction, and speed of moving objects. The invention further offers countermeasures if image processing is disable due to trouble of two-dimensional image sensor, or if an individual moving object cannot be distinguished in the crowd.

BEST MODE FOR CARRYING OUT THE INVENTION

Exemplary embodiments of the invention are described below while referring to the drawings. FIG. 1A is a front view of automatic door apparatus of the present embodiment, and FIG. 1B is a plan view of automatic door apparatus. FIG. 2 is a view of system configuration of control unit of automatic door apparatus. A pair of left and right doors 10L, 10R of the automatic door apparatus are out of housing frames 11L, 11R in closed state, and stowed in the housing frames 11L, 11R in open state. Above the doors 10L, 10R and housing frames 11L, 11R, horizontal rails 12 are laid. At the upper edge of doors 10L, 10R, two linear motors 13L, 13R (moving means) are provided individually. When the linear motors 13L, 13R are driven, the linear motors 13L, 13R move along the rails 12, and the doors 10L, 10R move on a same vertical plane P.

The linear motors 13L, 13L are driven by a motor controller 14L, and the linear motors 13R, 13R are driven by a motor controller 14R, individually. The motor controllers 14L, 14R control the linear motors 13L, 13L and linear motors 13R, 13R individually depending on the target position signals (target opening degree signals of doors 10L, 10R) and target speed signals (target speed signals of doors 10L, 10R) from a central control unit 16. Actual positions of doors 10L, 10R are detected by position sensors 15L, 15R. Detection signals are fed back to the motor controllers 14L, 14R.

On the ceiling of inside and outside of doors 10L, 10R, television cameras (two-dimensional image sensors) 18A, 18B are installed as main sensors, and infrared ray sensors 20A, 20B are installed as spare sensors. Video signals from the television cameras 18A, 18B are input to the central control unit 16. The central control unit 16 has means for processing video signals from television cameras 18A, 18B and detection signals from infrared ray sensors 20A, 20B, and outputs the target position signals and target speed signals to the motor controllers 14L, 14R. In case of trouble, such as failure of image processing due to trouble or optical conditions, or failure of calculation of position and moving speed due to trouble in recognition of individual moving object in the crowd, the central control unit 16 outputs full opening or closing signals of doors 10L, 10R to the motor controllers 14L, 14R on the basis of detection signals from infrared ray sensors 20A, 20B used as spare sensors.

As shown in FIG. 2, the imaging zone of television camera 18A includes a first zone Al remote from the doors 10L, 10R, and a second zone A2 between the first zone A1 and the doors 10L, 10R. Similarly, the imaging zone of other television camera 18B includes a first zone B1 remote from the doors 10L, 10R, and a second zone B2 between the first zone B1 and the doors 10L, 10R. The first zone A1 and first zone B1, and the second zone A2 and second zone B2 are respectively symmetrical to each other. The imaging zones of television cameras 18A, 18B are actually slightly wider to the outside of the first zones A1, B1. The infrared ray sensors 20A, 20B are set to detect the moving objects in a specified range from the doors 10L, 10R, same as the moving object detecting sensors of ordinary automatic doors.

FIG. 3 is a block diagram of function of the central control unit 16. The central control unit 16 includes image processing means 16-1, moving status calculating means 16-2, opening degree calculating means 16-3, and first move command means 16-4. The image processing means 16-1 processes video signals from the television cameras 18A, 18B. The moving status calculating means 16-2 calculates the position, moving direction and moving speed of moving object from the image processing signals of the image processing means 16-1. The opening degree calculating means 16-3 predicts the passing position of moving object on the vertical plane on the basis of the position and moving direction of moving object calculated by the moving status calculating means 16-2 when the moving object approaches, and individually calculates the target opening degree of the pair of doors 10L, 10R on the basis of the predicted passing position, and determines the target opening degree of the doors in fully closed state when the moving object moves away. The first move command means 16-4 outputs move command signals to motor controllers 14L, 14R so that the pair of doors 10L, 10R may be opened to the calculated target opening degree.

The central control unit 16 also includes spare opening and closing means 16-5 and second move command means 16-6. The second move command means 16-6 outputs move command signals to motor controllers 14L, 14R to open or close the pair of doors 10L, 10R fully by moving object detection signals of the infrared ray sensors 20A, 20B as spare sensors if the image processing is disabled due to trouble of image processing means 16-1 or optical conditions, or if the position, moving direction and moving speed cannot be calculated due to failure of moving status calculating means 16-2 for individually recognizing a moving object in the crowd. These functions are executed by processing of microcomputer. The opening degree calculating means 16-3 includes provisional target position registers YL, YR for storing provisional target opening positions of left and right doors 10L, 10R, target position registers XL, XR for storing target opening positions of left and right doors 10L, 10R, and moving speed registers VL, VR for storing target moving speeds of left and right doors 10L, 10R.

Embodiment 1

Routine of periodic execution of every several units of msec by microcomputer of central control unit 16 is explained while referring to the flowcharts in FIG. 4A and FIG. 4B. First, the central control unit 16 judges if image processing is disabled or not (including both failure of image processing due to trouble of apparatus and failure of image processing due to optical conditions) (step ST1). If all right, the central control unit 16 calculates the position, size, speed and direction of a moving object entering the imaging zones of television cameras 18A, 18B from image processing signals, and labels the moving object to distinguish from other moving objects (step ST2). The central control unit 16 then judges if a moving object cannot be identified in the crowd or not (failure of image processing) (step ST3), and if all right, recognizes the second zones (areas) A2 and B2 (step ST4)

The central control unit 16 judges if there is any moving object moving from the first zone (area) A1 or B1, that is, judges if any moving object is approaching the door 10L or 10R or not (step ST5). If any moving object is approaching, the central control unit 16 calculates the target moving speeds and provisional target positions (provisional target opening positions) of left and right doors 10L, 10R (step ST6), and writes the moving speeds into moving speed registers VL, VR, and writes the provisional target positions into provisional target position registers YL, YR (step ST7). Then, the central control unit 16 judges if the value of provisional target position register YL is greater than the value of target position register XL (YL>XL) or not (step ST8), and if greater, the target position of target position register XL is updated by the target position of provisional target position register YL (step ST9) Successively, the central control unit 16 judges if the value of provisional target position register YR is greater than the value of target position register XR (YR>XR) or not (step ST10), and if greater, the target position of target position register XR is updated by the target position of provisional target position register YR (step ST11).

Further, the central control unit 16 judges if other moving object is present in the second zone A2 or B2 or not (step ST12). If present, the central control unit 16 returns to previous step ST6, and repeats the same process, and if not present, it outputs the target positions of target position registers XL, XR and moving speeds of moving speed registers VL, VR, to the motor controllers 14L, 14R by way of the first move command means 16-4 (step ST16).

At step ST5, if there is no moving object moving from the first zone A1 or B1, the central control unit 16 recognizes the first zones A1 and B1 (step ST13), and judges if any moving object is moving from the second zone A2 or B2 (step ST14). If there is, that is, if there is any object moving away from the door 10L or 10R, the central control unit 16 stores the closing positions of doors 10L, 10R (fully closing positions) in the target position registers XL, XR (step ST15), and moves to step ST16.

In the event of image processing failure at step ST1, or individual recognition failure of moving object in the crowd at step ST3, the central control unit 16 checks the spare sensors, that is, infrared ray sensors 20A, 20B (step ST17), and judges if the infrared ray sensor 20A or 20B is turned on, that is, if any moving object is detected or not (step ST18). If any moving object is detected, the central control unit 16 stores the opening positions of doors 10L, 10R (fully opening positions) in the target position registers XL, XR (step ST19), and moves to step ST16. If moving object is not detected, the central control unit 16 stores the closing positions of doors 10L, 10R in the target position registers XL, XR (step ST20), and moves to step ST16. That is, in the event of image processing failure at step ST1, and individual recognition failure of moving object in the crowd at step ST3, same operation as in ordinary opening and closing of automatic doors is executed by the infrared ray sensors 20A, 20B.

Embodiment 2

Other routine of execution by microcomputer of central control unit 16 is explained while referring to the flowchart in FIG. 5. This routine differs from the routine in FIG. 4A as follows: in the event of individual recognition failure of moving object in the crowd at step ST3, the central control unit 16 immediately goes to step ST19, and stores the opening positions of doors 10L, 10R (fully opening positions) in the target position registers XL, XR, and moves to step ST16. That is, in the event of individual recognition failure of moving object in the crowd, the central control unit 16 fully opens the doors 10L, 10R in order to assure smooth passing.

In the automatic door apparatus having such construction, a specific example of operation is explained. As shown in FIG. 6, when a person (moving object) 101 tries to pass the center of vertical plane P, that is, the mutually abutting position of doors 10L, 10R, the both doors 10L, 10R open slightly. As shown in FIG. 7, when a person 101 approaches one door 10L, only this door 10L is opened and the other door 10R remains closed. As shown in FIG. 8, when three people 101, 102, 103 try to pass the vertical plane P nearly at the same time, the both doors 10L, 10R are fully opened. As shown in FIG. 9, when a person enters the first zone A1 or B1, but leaves without entering the second zone A2 or B2, the doors 10L, 10R remain fully closed.

The invention is not limited to the foregoing embodiments, but may be changed and modified in various manners. For example, the border of two zones for obtaining open command timing when the moving object approaches, and the border of two zones for obtaining close command timing when the moving object moves away from the doors may be different. The opening speed of doors 10L, 10R may be proportional to the deviation of target position and actual position of doors 10L, 10R. Two-dimensional image sensors are not limited to television cameras, but maybe infrared ray image sensors. Spare sensors are not limited to infrared ray sensors, but may be any other sensors capable of detecting the moving object in a specified range from doors 10L, 10R, including such as ultrasonic sensors and mat switches.

DESCRIPTION OF REFERENCE NUMERALS

Figure 1A:
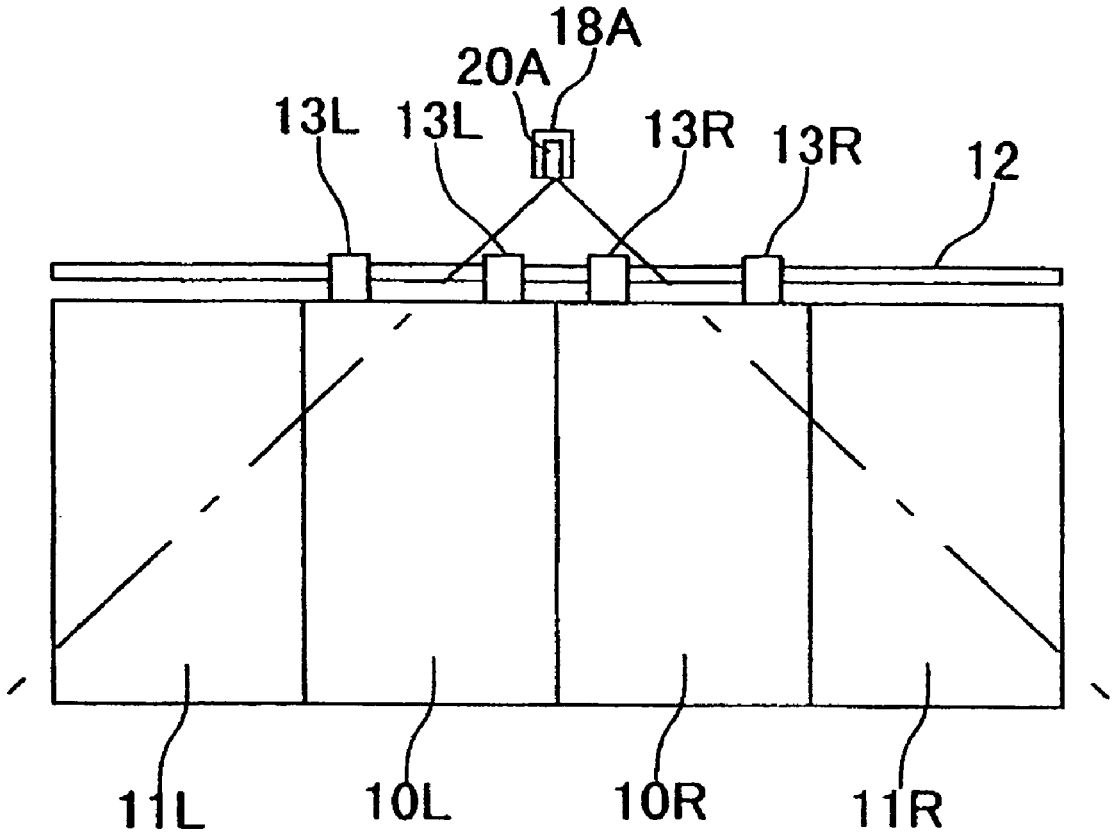
FIG. 1A is a front view of automatic door apparatus.
Figure 1B:
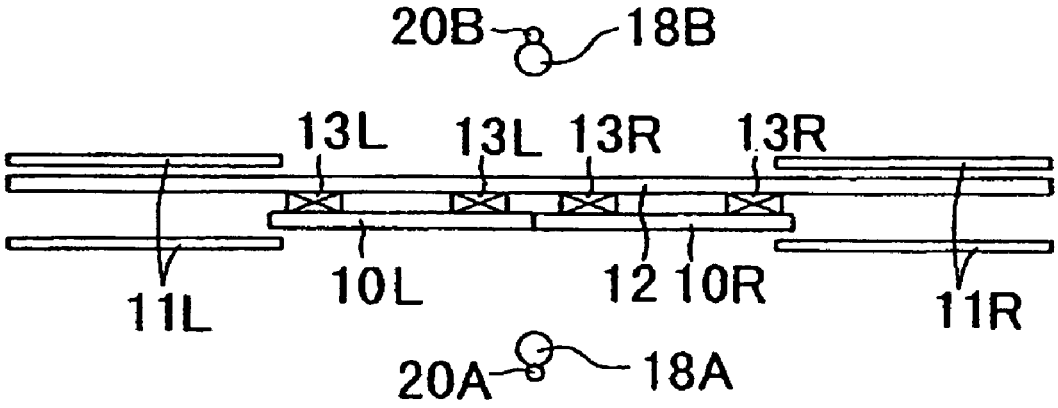
FIG. 1B is a plan view of automatic door apparatus.
Figure 2:
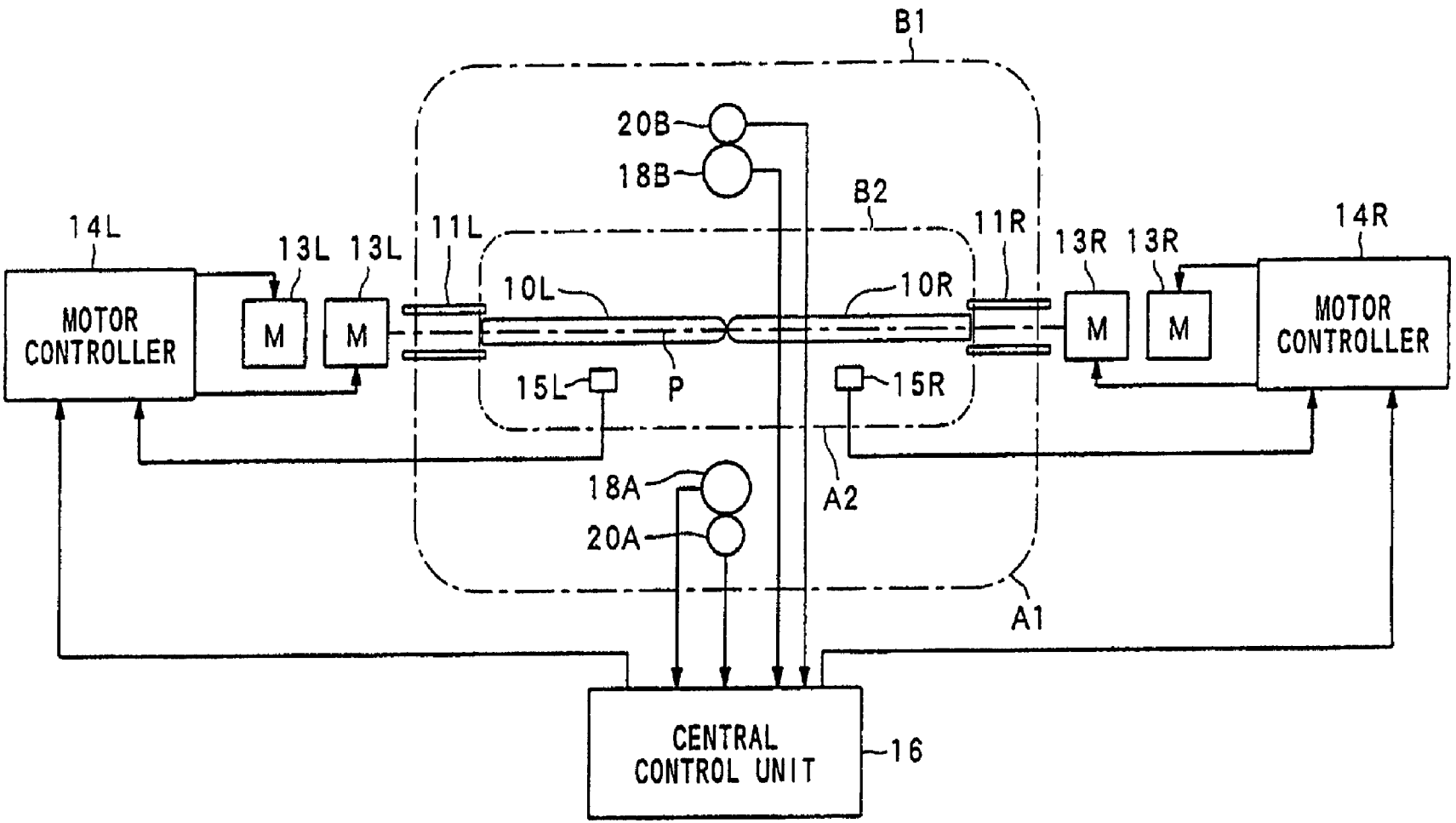
FIG. 2 is a view of system configuration of control unit of automatic door apparatus.
Figure 3:
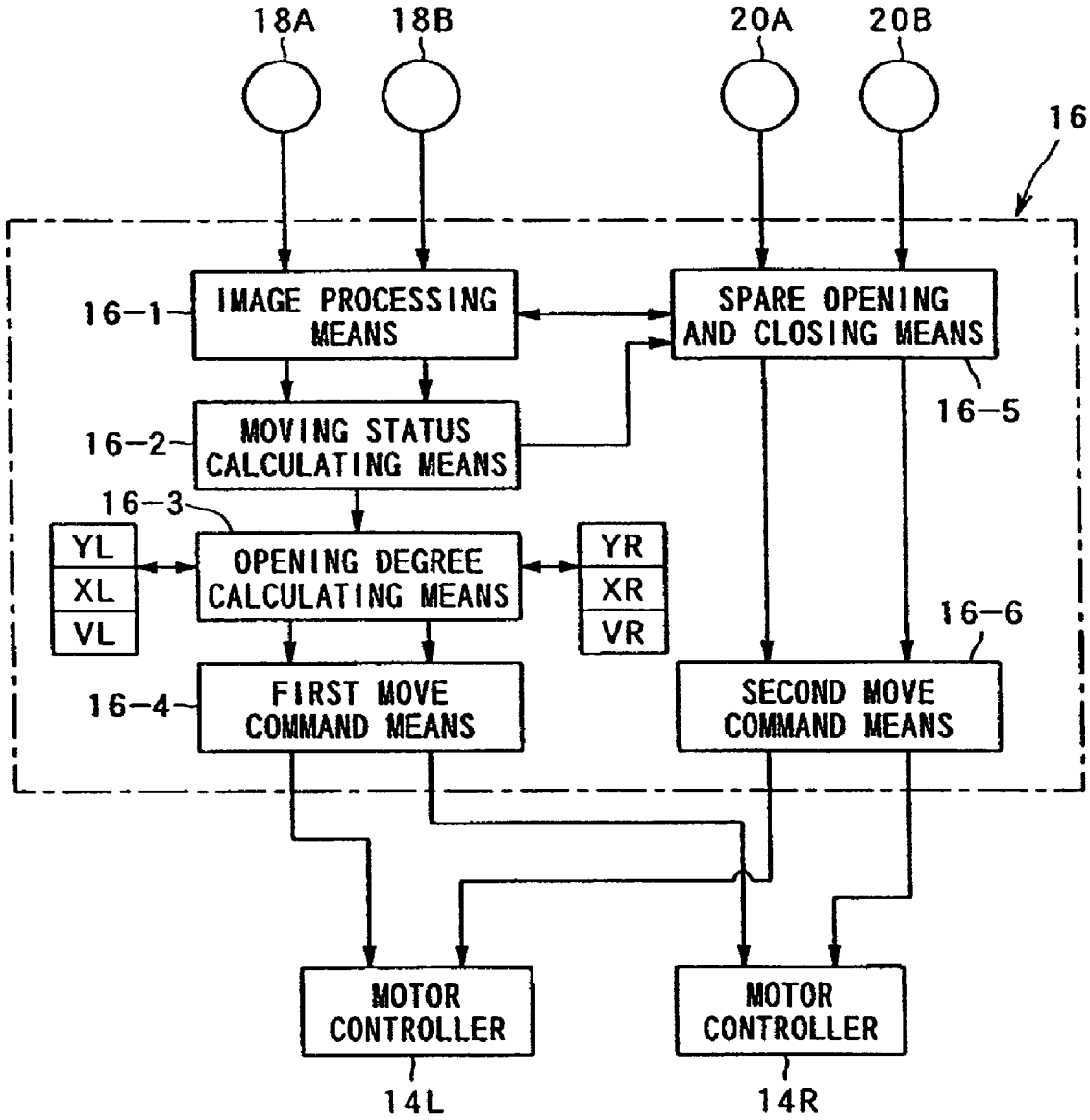
FIG. 3 is a block diagram of function of central control unit of automatic door apparatus.
Figure 4A:
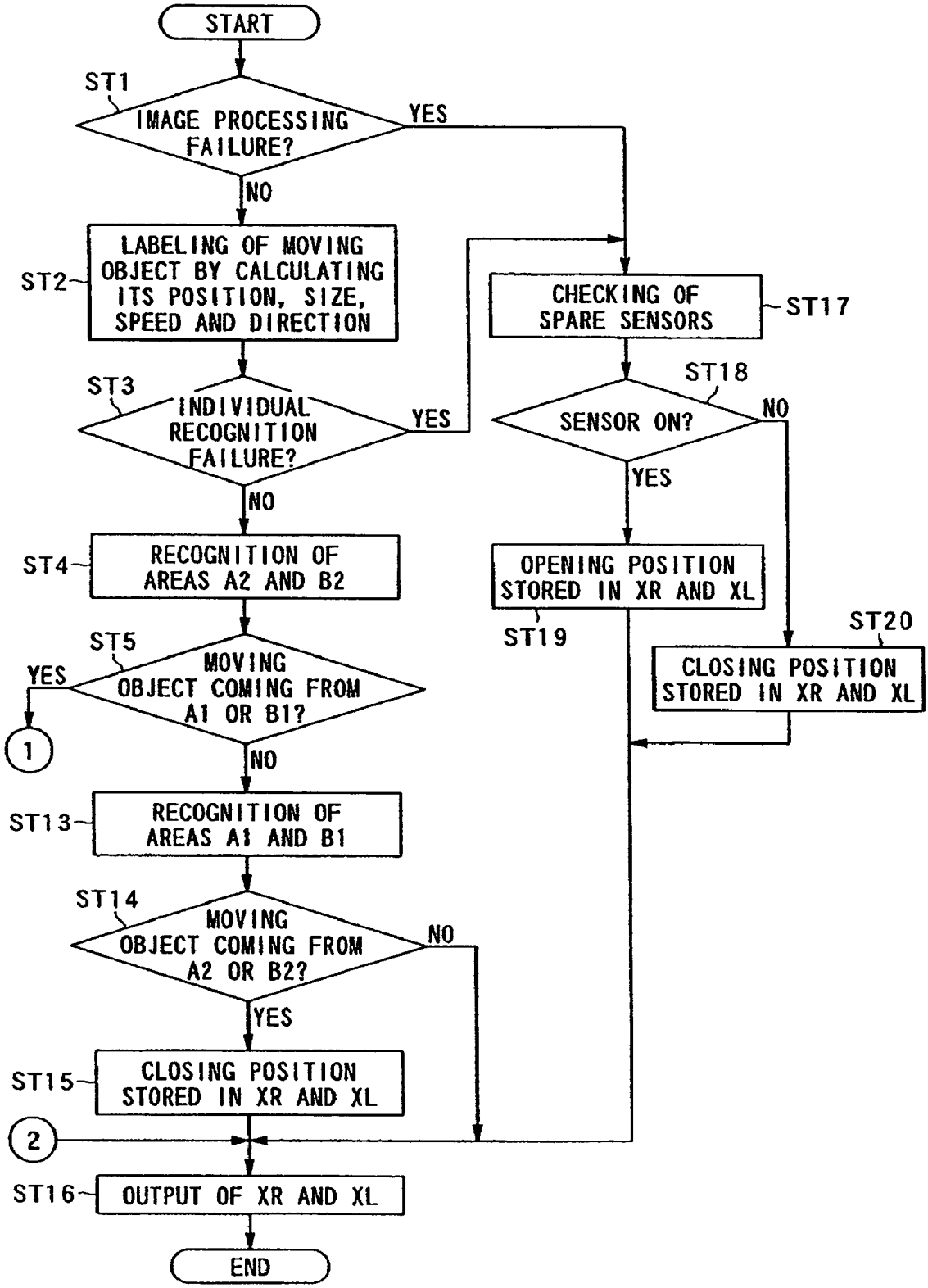
FIG. 4A is a flowchart of control routine of automatic door apparatus (embodiment 1).
Figure 4B:
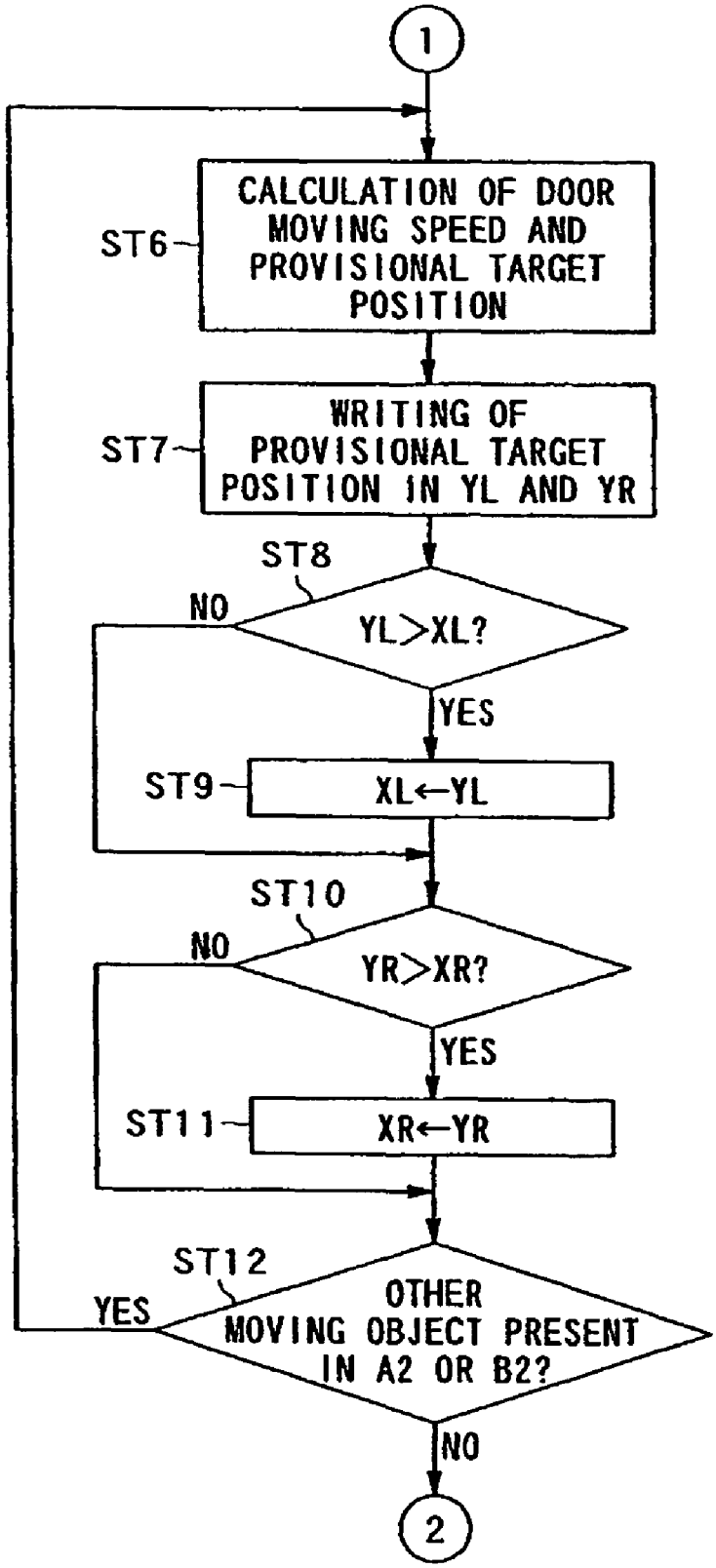
FIG. 4B is a flowchart of control routine of automatic door apparatus (embodiment 1).
Figure 5:
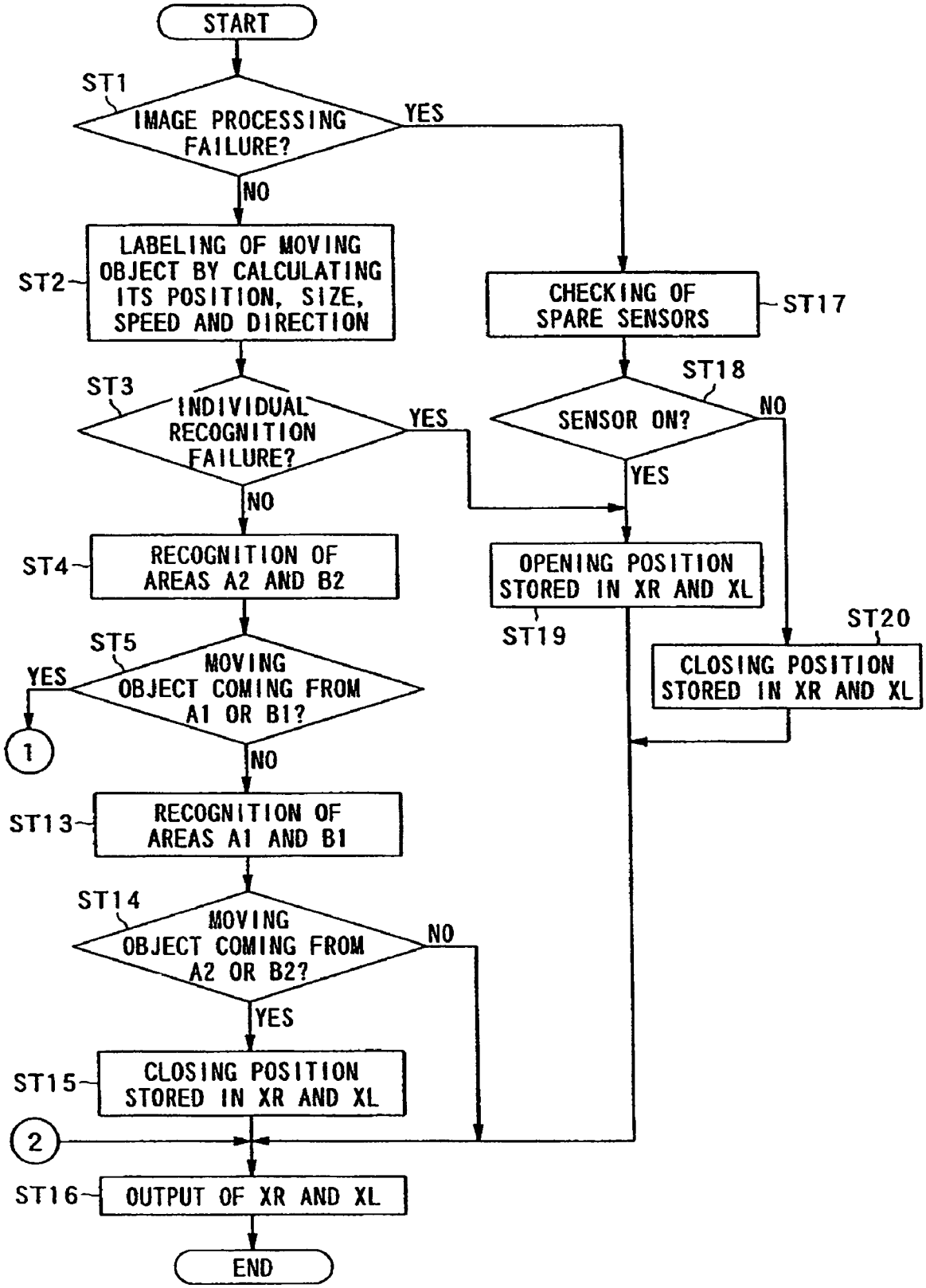
FIG. 5 is a flowchart of control routine of automatic door apparatus (embodiment 2).
Figure 6:
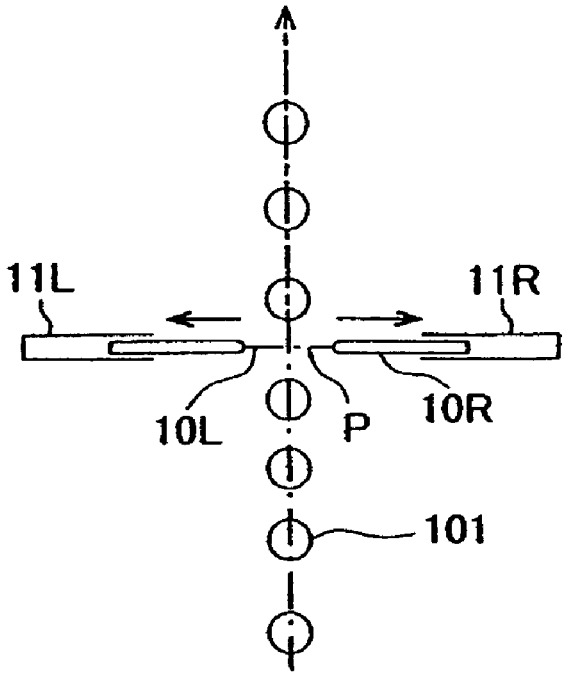
FIG. 6 is a plan view showing an example of opening and closing operation of doors of automatic door apparatus.
Figure 7:
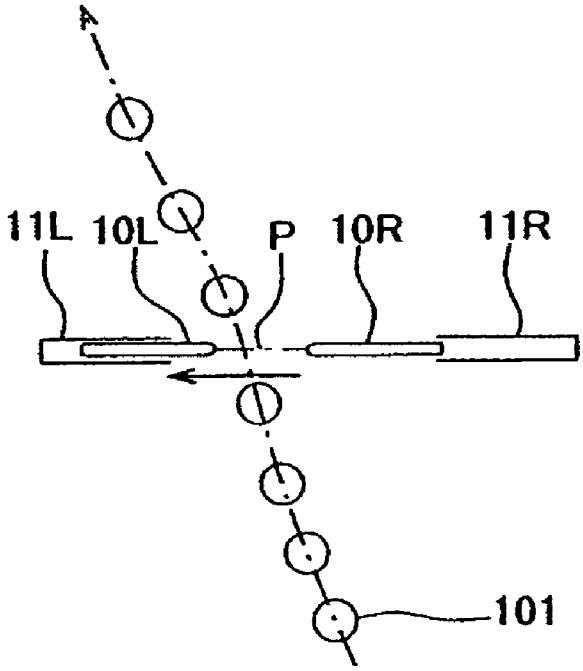
FIG. 7 is a plan view showing other example of opening and closing operation of doors of automatic door apparatus.
Figure 8:
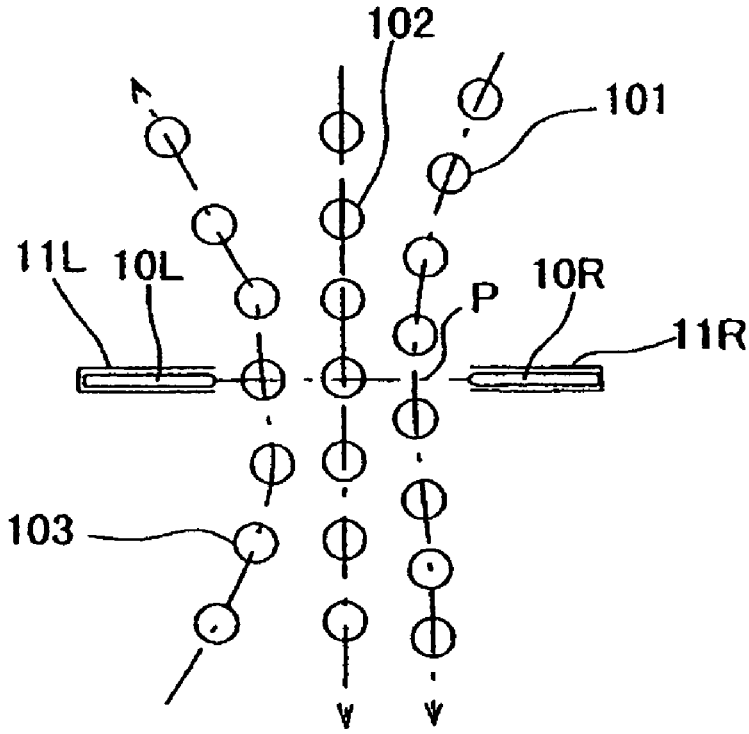
FIG. 8 is a plan view showing other example of opening and closing operation of doors of automatic door apparatus.
Figure 9:
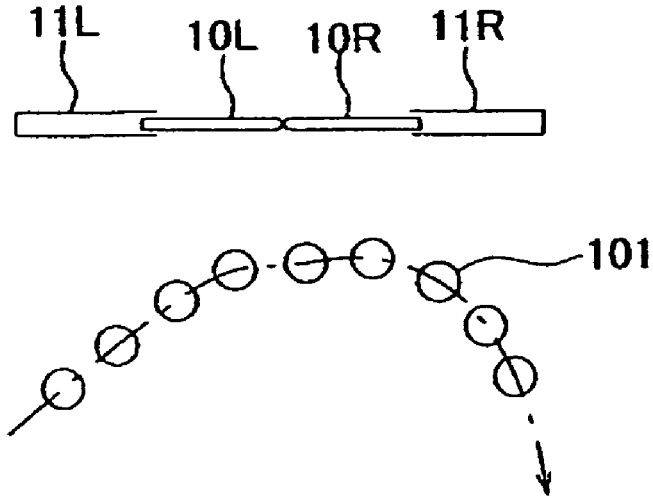
FIG. 9 is a plan view showing other example of opening and closing operation of doors of automatic door apparatus.

10L Door
10R Door
11L Housing frame
11R Housing frame
12 Rail
13L Linear motor
13R Linear motor
14L Motor controller
14R Motor controller
15L Position sensor
15R Position sensor
16 Central control unit
18A Television camera
18B Television camera
20A Infrared ray sensor
20B Infrared ray sensor

The invention claimed is:

1. An automatic door apparatus comprising:

a pair of doors opening and closing by moving on a same vertical plane;

a pair of moving device moving the pair of doors individually;

a controller controlling the pair of moving device;

a pair of two-dimensional image sensors for detecting a moving object at both sides of the pair of doors; and a pair of spare sensors for detecting a moving object at both sides of the pair of doors, wherein the controller includes:

an image processor processing an output of the two-dimensional image sensors;

a moving status calculator individually recognizing the moving object and calculating a position and a moving direction of the moving object from an image processing signal of the image processor wherein the moving status calculator judges if the image processor is one of disabled due to an apparatus trouble or due to an optical condition and not disabled;

an opening degree calculator predicting a passing position of the moving object on the vertical plane on the basis of the position and moving direction of the moving object calculated by the moving status calculator and calculating a target opening degree of each of the doors on the basis of the predicted passing position when the moving object approaches, and determining the target opening degrees of the doors in fully closed state when the moving object moves away;

a first move command unit outputting move command signals to the pair of moving device so that the doors may be opened to the calculated target opening degrees; and a second move command unit outputting move command signals to the pair of moving device to open the doors fully immediately or after the moving object is detected by the spare sensor if the moving status calculator cannot calculate the position and moving direction of the moving object due to individual recognition failure of the moving object in the crowd even if the moving status calculator indicates the image processor is not disabled.

2. An automatic door apparatus according to claim 1, wherein the controller selects a largest opening degree, as the target opening degree of the door, from plural target opening degrees corresponding to plural moving objects calculated by the opening degree calculator.

3. An automatic door apparatus according to claim 1, wherein the moving status calculator has an opening speed calculator calculating a moving speed of each moving object and calculating an opening speed of the doors on the basis of the fastest moving speed among the calculated moving speeds, and the first move command unit outputs a move command signal so as to open the doors at the opening speed.

4. An automatic door apparatus according to claim 1, wherein a zone detected by the two-dimensional image sensor includes a first zone remote from the doors, and a second zone adjacent to the first zone and closer to the doors than the first zone, the moving status calculator calculates the moving status of the moving object on the basis of the motion of the moving object in the first zone, and the opening degree calculator calculates the target opening degree when the moving object moves from the first zone to the second zone, and the first move command unit outputs the move command signal.

5. An automatic door apparatus according to claim 1, wherein a zone detected by the two-dimensional image sensor includes a first zone remote from the doors, and a second zone adjacent to the first zone and closer to the doors than the first zone, and the opening status calculator sets the target opening degree in full closing when the moving object moves from the second zone to the first zone, and the first move command unit outputs the move command signal.

* * * * *